United States Patent [19]

Preece

[11] 4,124,789

[45] Nov. 7, 1978

[54] PRESSURE SWITCH ACTUATOR

[75] Inventor: Graham M. Preece, Checkley, England

[73] Assignee: The Haigh Engineering Company Limited, Ross-on-Wye, England

[21] Appl. No.: 786,871

[22] Filed: Apr. 12, 1977

[30] Foreign Application Priority Data

Apr. 27, 1976 [GB] United Kingdom ..... 16988/76

[51] Int. Cl.[2] ..... H01H 35/30

[52] U.S. Cl. ..... 200/81 R; 200/83 Z; 241/32.5

[58] Field of Search ..... 241/32.5; 200/81 R, 200/83 R, 83 B, 83 C, 83 Z, 61.6, 42 R

[56] References Cited

U.S. PATENT DOCUMENTS

| | | | |
|---|---|---|---|
| 2,657,397 | 11/1953 | Drew | 241/32.5 |
| 2,979,274 | 4/1961 | Tull | 241/32.5 |
| 3,219,778 | 11/1965 | Treffeisen | 200/83 B |
| 3,425,637 | 2/1969 | Enright | 241/32.5 |
| 3,900,710 | 8/1975 | Potter | 200/83 Z |

*Primary Examiner*—Gerald P. Tolin

*Attorney, Agent, or Firm*—Wellington M. Manning, Jr.; Luke J. Wilburn, Jr.

[57] ABSTRACT

A motor control circuit for the comminuter motor of a waste disposal unit, incorporating an air sack around the inlet to the waste disposal unit, and a pressure responsive electrical switch, the motor being de-energized in absence of a pressure signal from the sack caused by the insertion of a safety guard in the inlet.

3 Claims, 2 Drawing Figures

PRESSURE SWITCH ACTUATOR

This invention is concerned with the control of electric motors in wet or damp environments, and is particularly concerned with waste disposal apparatus.

While the invention will be described in relation to waste disposal apparatus, it will be understood that the invention has wider applications.

With domestic waste disposal apparatus it is clearly dangerous to allow operation while there is unrestricted access to the comminuter of the waste disposal apparatus. It is therefore desirable to provide a guard on the inlet to the comminuter, the guard operating a control switch in the comminuter motor control circuit to allow or cause energisation of the motor.

It is an object of the present invention to provide such a guard operated switch arrangement that is not adversely affected by the wet environment of the guard.

The present invention is a motor control circuit incorporating a pressure operated switch, a flexible air sack communicating with the switch, and a member locatable to act upon the sack to increase the pressure therein and thereby operate the switch.

Preferably the air sack and the member are annular.

The air sack may be located around the access opening to a waste disposal comminuter and the member may be a guard member.

The present invention is also a sink outlet pipe having a flexible air sack secured thereto, a removable guard member being located in the outlet to act upon the sack to reduce the volume thereof.

Preferably the sack is annular and is secured round the internal wall of the pipe.

A cover may be provided to protect the sack.

An embodiment of the present invention will now be described, by way of example, with reference to the accompanying drawings, in which.

Figure 1:
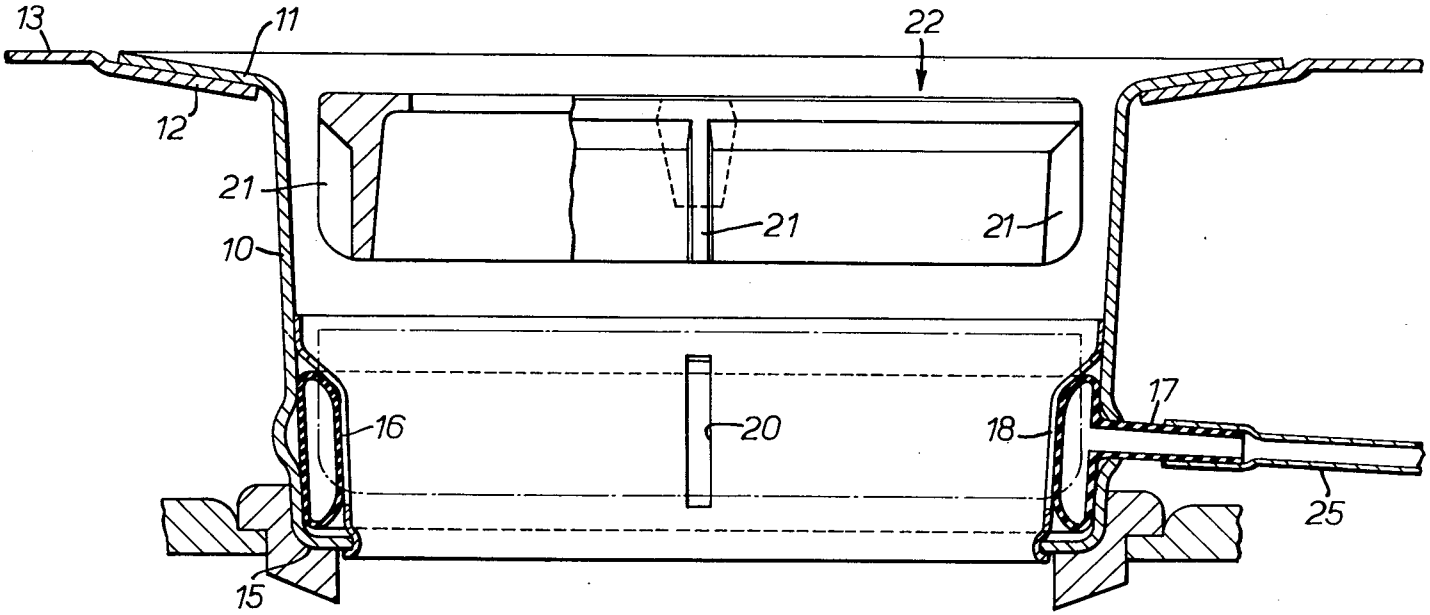
FIG. 1 is a sectional elevation through a sink outlet pipe.

Referring now to the drawings, a sink outlet pipe 10 is supported by an external flange 11 on a dished ring 12 surrounding the opening in the bottom 13 of a sink. The outlet pipe 10 provides communication between the sink and waste disposal apparatus (not illustrated) which incorporates a comminuter driven by an electric motor.

The pipe 10 has at its lower end an internal flange 15 on which is supported a flexible air sack 16 which is annular and is located against the interior surface of the pipe. An outlet pipe 17 leads from the sack 16 through the wall of the pipe 10. A cover 18 is provided over the air sack 16 to protect it against mechanical damage.

Figure 2:
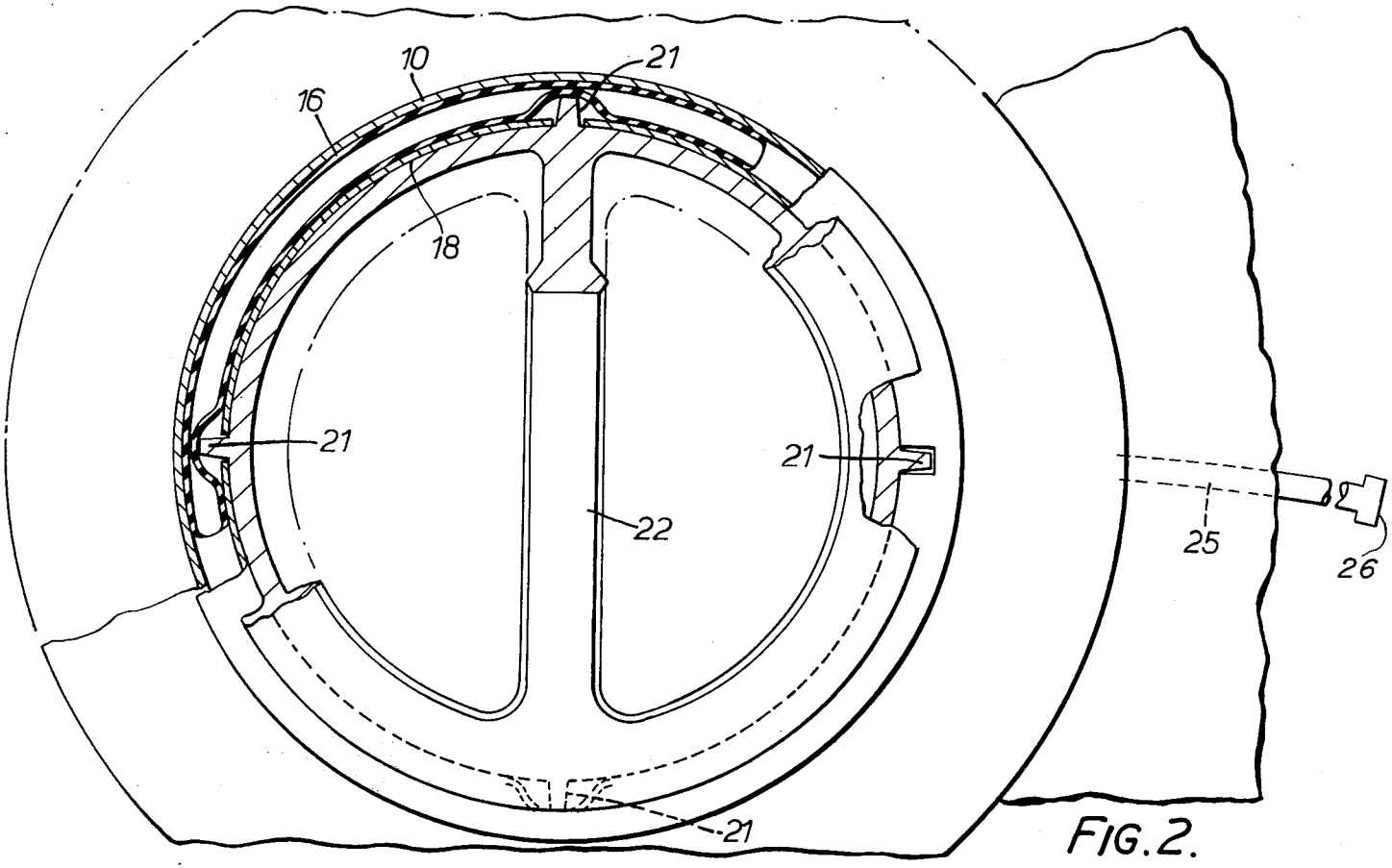
FIG. 2 is a part sectional plan view of the outlet pipe of FIG. 1.

A number, in this embodiment four, spaced axially extending openings 20 are provided in the cover 18 to co-operate with axially extending keys 21 on the periphery of a guard member 22 which is removably mounted on the cover 18. When the member 22 is in position on the cover 18, as seen in FIG. 2, the keys 21 pass through the openings 20 and engage the sack 16 to reduce its volume. The guard member 22 acts to restrict access from the sink to the space below the pipe 10 in which the comminuter operates.

The outlet pipe 17 is connected by a capillary tube 25 to a pressure operated switch 26 (see FIG. 2) in the supply circuit to the motor driving the comminuter.

Considering now the operation of the embodiment described. In the absence of the guard member 22 access to the comminuter is unrestricted and, for example, a person's fingers could be inserted into the comminuter space. However the pressure operated switch 26 in the motor supply circuit is open thus preventing energisation of the comminuter motor so that there is no danger. To close the pressure operated switch 26 thus causing or at least permitting energisation of the motor it is necessary to insert the guard member 22 to cause its keys to act upon the sack 16 to increase the pressure therein, the increased pressure being of course transmitted to the pressure operated switch 26 by the tube 25. When the guard member is in position, of course, a person's fingers cannot be inserted into the comminuter space.

The embodiment described thus has desirable safety features while avoiding problems associated with electrical switches in the wet environment of the guard member.

I claim:

1. A pressure switch actuator controlling energization of a motor in a waste disposal apparatus, the actuator comprising an annular flexible air sack located around an access opening to the waste disposal apparatus, a pressure operated switch in communication with said air sack and operatively associated with said motor, a cover located over said air sack to provide protection therefor, and an annular guard member locatable in said opening to act on said air sack to increase the pressure therein and thereby actuate said switch.

2. The pressure switch actuator as defined in claim 1 wherein said cover has at least one opening therein and said guard is provided with a member that is receivable in said cover opening to act directly on said air sack.

3. The pressure switch actuator as defined in claim 2 wherein said guard has a plurality of openings spaced therearound and said guard has a like member or members receivable in said openings to act on said air sack at each opening.

* * * * *